US006203370B1

(12) United States Patent
Lee

(10) Patent No.: US 6,203,370 B1
(45) Date of Patent: Mar. 20, 2001

(54) ELECTRICAL CONNECTOR WITH AN O-RING

(76) Inventor: Noel Lee, 5810 Coolwater Cove, Dallas, TX (US) 75252

( * ) Notice: Subject to any disclaimer, the term of this patent is extended or adjusted under 35 U.S.C. 154(b) by 0 days.

(21) Appl. No.: 09/244,332

(22) Filed: Feb. 3, 1999

(51) Int. Cl.[7] ..... H01R 13/40
(52) U.S. Cl. ..... 439/589; 439/583; 439/905
(58) Field of Search ..... 439/589, 668, 439/669, 578, 583, 905, 461

(56) References Cited

U.S. PATENT DOCUMENTS 3,708,780 * 1/1973 Pierce ..... 439/589
3,847,463 * 11/1974 Hayward et al. ..... 439/578
4,358,174 * 11/1982 Dreyer ..... 439/578
5,139,444 * 8/1992 Garay et al. ..... 439/668
5,439,386 * 8/1995 Ellis et al. ..... 439/578
5,529,522 * 6/1996 Huang ..... 439/578
5,662,489 * 9/1997 Stirling ..... 439/578
5,667,405 * 9/1997 Holliday ..... 439/578
5,673,945 * 10/1997 Olson ..... 285/322

* cited by examiner

*Primary Examiner*—Khiem Nguyen
*Assistant Examiner*—Hae Moon Hyeon
(74) *Attorney, Agent, or Firm*—Lariviere, Grubman & Payne, LLP

(57) ABSTRACT

An electrical connector with a threaded shell which screws on to a threaded connector body, and including an O-ring disposed between the shell and body. The O-ring is made of an elastic material and is placed over the threaded portion and against a shoulder of the connector body so that when the shell is screwed onto the threaded portion of the connector body the O-ring is compressed between the end of the shell and the body shoulder, thereby providing increased friction between the shell and connector body to resist unscrewing of the shell from the body by vibrations and similar random forces.

7 Claims, 2 Drawing Sheets

© 1997 MONSTER CABLE PRODUCTS, INC.

© 1997 MONSTER CABLE PRODUCTS, INC.

ELECTRICAL CONNECTOR WITH AN O-RING

FIELD OF THE INVENTION

The present invention relates to electrical connectors. More particularly, the present invention relates to electrical connectors with screw on shells.

BACKGROUND OF THE INVENTION

In prior art electrical connectors, a shell is placed over an connector body to provide electrically insulative shielding or mechanical integrity around the connection between the connector body and an attached electrical wire.

Some prior art electrical connectors mold the shell onto the connector body. Some cylindrical prior art shells screw onto cylindrical connector bodies. Screw on shells allow for the splicing of an electrical connector at the end of a conducting wire. A problem with the prior art shells that screw onto connector bodies is that they can easily become loosened and become unscrewed from the connector bodies by vibrations or other actions.

Accordingly, it is an object of the present invention to provide a shell that is screwed onto an connector body that does not easily become unscrewed from the connector body when the electrical connector is subjected to vibrations or other forces.

BRIEF SUMMARY OF THE INVENTION

Accordingly, the foregoing object is accomplished by providing an O-ring between a screw on shell and an connector body.

Other features of the present invention are disclosed or apparent in the section entitled: "DETAILED DESCRIPTION OF THE INVENTION."

BRIEF DESCRIPTION OF DRAWINGS

For fuller understanding of the present invention, reference is made to the accompanying drawings wherein.

Figure 1:
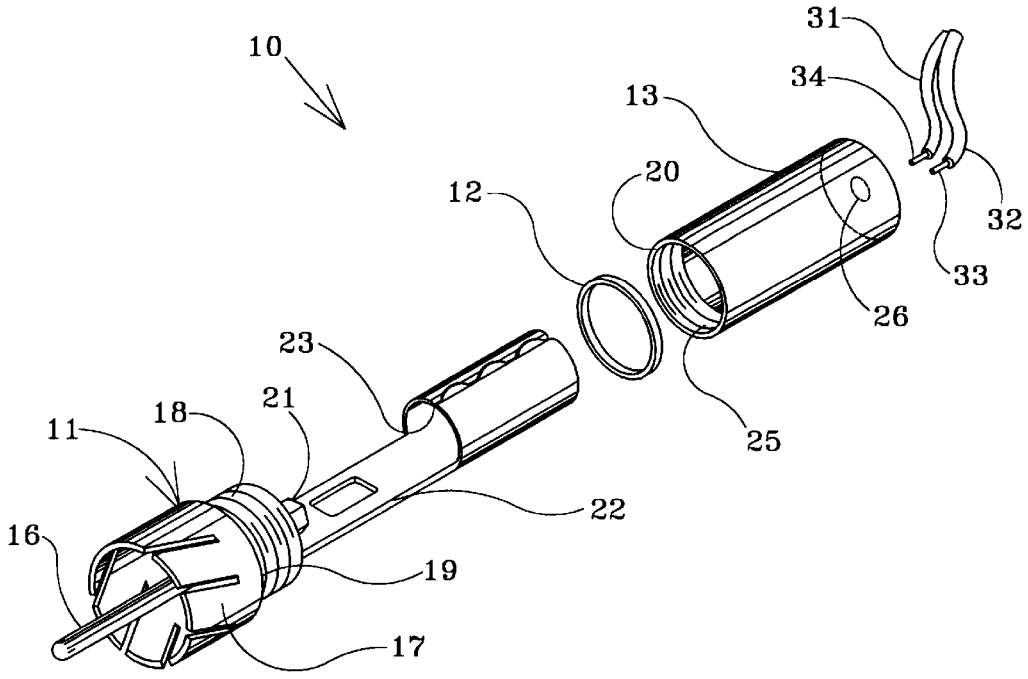
FIG. 1 illustrates an exploded view of an electrical connector according to the invention.

Reference numbers refer to the same or equivalent parts of the present invention throughout the figures of the drawing.

DETAILED DESCRIPTION OF THE INVENTION

As briefly discussed above, and as shown in FIG. 1, an electrical connector 10 comprises a connector body 11, an O-ring 12, and a shell 13. In a preferred embodiment of the invention, the electrical connector is an RCA, a trademark of RCA connector (or jack). RCA connectors are often found in video and audio recording, storage, transcription and playback equipment. In this embodiment, the connector body 11 comprises a pin 16 on a plug side of the connector body 11, an outer sleeve 17 surrounding the pin 16 and electrically insulated from the pin by an insulator (not shown and forms no part of the present invention) on the plug side of the connector body 11. Threaded portion 18 of the connector body 11, having a smaller overall diameter than the outer sleeve 17, forms a shoulder 19 between the threaded portion 18 and the outer sleeve 17, as shown. Thus the outer sleeve 17 forms a wider portion of the connector body 11 since the outer sleeve 17 has a wider outer diameter than the threaded portion 18. A first receiver 21 is electrically connected to the pin 16 and is on a receiver side of the connector body 11, which is the opposite side of the connector body 11 from the plug side. A second receiver 22 is electrically connected to the outer sleeve 17 and is on the receiver side of the connector body 11. An end of the second receiver 22 away from the threaded portion 18 is formed into a crimp connector 23.

The O-ring 12 is an elastomeric material such as rubber formed in the shape of an "O". In the preferred embodiment, the inner diameter of the O-ring is approximately equal to the outer diameter of the threaded portion 18, and smaller than the outer diameter of the outer sleeve 17. In other embodiments, the inner diameter of the O-ring is less than the outer diameter of the threaded portion 18 and is stretched over the threaded portion 18. The shell 13 has a cylindrical inside diameter with a first end and a second end. The first end of the shell 13 is open and is threaded with threads 25, that mate with threads of the threaded portion 18 making the shell 13 threadably engagable with the threaded portion 18. At the end of the first end of the shell 13 is an edge 20 of the shell 13. The second end of the shell 13 is closed except for a small aperture 26 passing through the second end. In the preferred embodiment, the shell 13 is made of an insulative material such as hard plastic.

An electrical wire 31 is formed by an insulator 32 surrounding a first conductor 33 and a second conductor 34.

In operation, the connector body 11 is inserted into the O-ring 12 . A first end of the wire 31 is passed through the aperture 26 of the shell 13, and then through the crimp connector 23 of the second receiver 22. The first conductor 33 is electrically and mechanically connected to the first receiver 21, by crimping the first receiver 21 or soldering the first conductor 33 to the first receiver 21, or by other mechanical means. The second conductor 34 is electrically and mechanically connected to the second receiver 22 by crimping the second receiver or soldering the second conductor 34 to the second receiver 22 or by other mechanical means. The crimp connector 23 is then crimped to mechanically connect the crimp connector 23 to the insulator 32.

The threads 25 of the shell 13 are placed near the threaded portion 18, so that the shell 13 covers the first receiver 21 and the second receiver 22. The threads 25 of the shell are threadably engagable with the threaded portion 18 so that the shell 13 can be screwed onto the threaded portion 18. As the shell 13 is screwed onto the threaded portion 18, the O-ring 12 is compressed between the edge 20 of the shell 13 and the shoulder 19 of the connector body 11.

Figure 2:
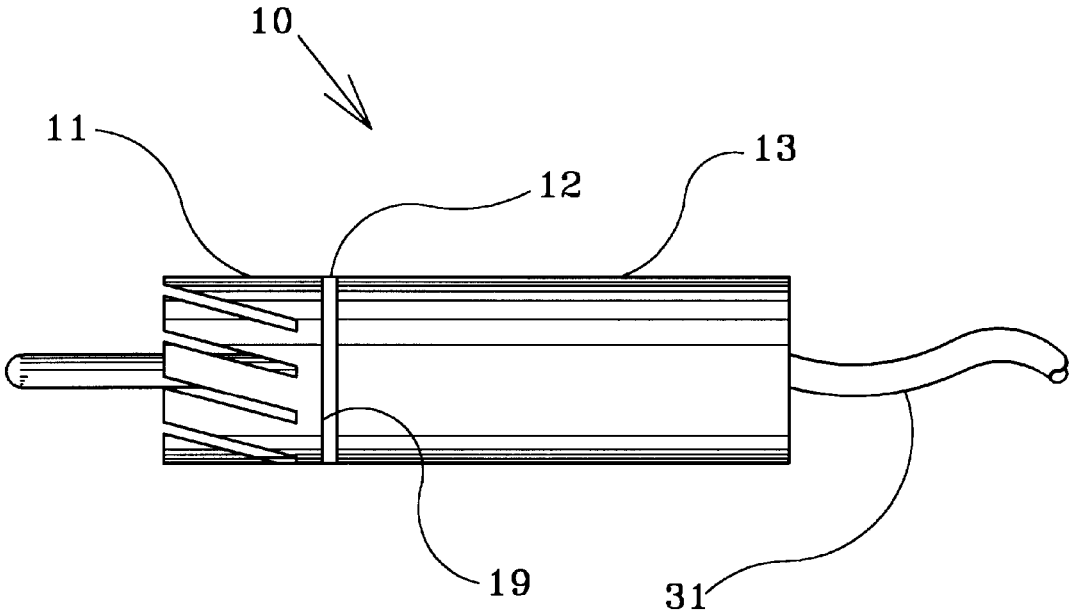
FIG. 2 is a side view of an assembled electrical conductor illustrated in FIG. 1.

FIG. 2 shows the assembled electrical connector 10, comprising the connector body 11, O-ring 12, and shell 13 with the attached electrical wire 31.

The O-ring 12 is elastic and has a higher force of friction than the shell 13 or the shoulder 19 of the metal connector body 11. The elasticity of the O-ring 12 and the O-ring force of friction prevents the shell 13 from becoming unscrewed from the connector body 11. With vibrations and other natural forces on the shell 13 the O-ring 12 prevents the shell 13 from loosening from the connector body 11.

In other embodiments of the invention, the pin and outer sleeve RCA connector is replaced with other types of plugs. For example another embodiment would place a headphone plug at the connector end of the connector body. The connector body could have any plug which uses a screw on shell. In another embodiment, the receiver end could have only one receiver, which is electrically connected to a wire having only one conductor. In the specification and claims, the term "plug" includes any combination of pins, sleeves, jacks and sockets. In other embodiments the shell may be made of an electrical conductor, such as brass, for use on a co-axial cable. Other embodiments could have more than two conductors such as multi-conductor co-axial cable.

The present invention has been particularly shown and described with respect to certain preferred embodiments and features thereof. However, it should be readily apparent to those of ordinary skill in the art that various changes and modifications in form and detail may be made without departing from the spirit and scope of the inventions as set forth in the appended claims. The inventions illustratively disclosed herein may be practiced without any element which is specifically disclosed herein.

I claim:

1. An electrical connector, comprising:

a connector body having at least one pin at a first end, the pin electrically insulated from the connector body and having a receiver for receiving an electrical wire, and having an exterior surface of the first end defining a first diameter, the connector body having an outside threaded portion having an outer diameter less than the first diameter, the connector body having a shoulder between the exterior surface and the threaded portion;

a flexible O-ring disposed over the threaded portion adjacent to the shoulder; and a shell having an inside threaded end having an edge for threadably engaging the outside threaded portion of the connector body, adjacent to the O-ring, whereby the O-ring is compressed between the shoulder of the connector body and the edge of the shell when the shell is screwed onto the threaded portion of the connector body, the O-ring thereby providing increased friction between the connector body and shell for resisting unscrewing forces.

2. The electrical connector, as recited in claim 1, wherein the connector body, comprises:

a plug on a plug side of the connector body; and a receiver on a receiver side of the connector body, wherein the receiver is electrically connected to the plug and wherein the plug side and the receiver side are on opposite sides of the threaded portion.

3. The electrical connector, as recited in claim 2, wherein the connector body, further comprises a crimp connector on the receiver side of the connector body.

4. The electrical connector, as recited in claim 3, wherein the elastomeric material is rubber.

5. The electrical connector, as recited in claim 4, wherein the plug comprises:

a pin electrically connected to the receiver; and a sleeve surrounding the pin.

6. A method for assembling an electrical connector, comprising the steps of:

inserting a connector body having at least one pin on a first end, the pin electrically insulated from the connector body and having a receiver for receiving an electrical wire, and having a shoulder adjacent to a threaded portion into an elastic O-ring, placing a shell having an edge adjacent to a threaded portion of the connector body;

screwing the shell onto the threaded portion of the connector body; and compressing the O-ring between the shell edge and the connector body shoulder, the O-ring thereby providing increased friction between the connector body and shell for resisting unscrewing forces.

7. The method, as recited in claim 6, further comprising the steps of:

threading an electrical wire through an aperture in the shell; and electrically connecting the electrical wire to a receiver in the connector body.

* * * * *